US008176577B2

(12) United States Patent
Grech et al.

(10) Patent No.: US 8,176,577 B2
(45) Date of Patent: May 15, 2012

(54) FLUSH TOILET WITH IMPROVED FLOW PATTERN

(75) Inventors: George Grech, Garden City, MI (US); Michael Harris, Dexter, MI (US); Jason Smith, West Bloomfield, MI (US); Steve Meyer, Whitmore Lake, MI (US); Eric Krupp, Canton, MI (US); Brian Kelly, Mason, MI (US)

(73) Assignee: Thetford Corporation, Ann Arbor, MI (US)

( * ) Notice: Subject to any disclaimer, the term of this patent is extended or adjusted under 35 U.S.C. 154(b) by 0 days.

(21) Appl. No.: 12/984,126

(22) Filed: Jan. 4, 2011

(65) Prior Publication Data

US 2011/0094023 A1 Apr. 28, 2011

Related U.S. Application Data

(62) Division of application No. 10/540,006, filed as application No. PCT/US2003/03802 on Nov. 26, 2003, now Pat. No. 7,861,331.

(60) Provisional application No. 60/430,130, filed on Nov. 30, 2002.

(51) Int. Cl.
*E03D 11/00* (2006.01)

(52) U.S. Cl. ..... 4/420; 4/308

(58) Field of Classification Search ..... 4/420, 308
See application file for complete search history.

(56) References Cited

U.S. PATENT DOCUMENTS

| | | | | |
|---|---|---|---|---|
| 155,814 | A * | 10/1874 | Stockton | 4/420 |
| 382,089 | A * | 5/1888 | Ivers | 4/420 |
| 3,334,358 | A * | 8/1967 | McPherson | 4/420 |
| 5,875,499 | A * | 3/1999 | Hoffman et al. | 4/420 |
| 2004/0040080 | A1 * | 3/2004 | Prokopenko et al. | 4/420 |

* cited by examiner

*Primary Examiner* — Gregory Huson
*Assistant Examiner* — Karen L Younkins
(74) *Attorney, Agent, or Firm* — Harness, Dickey & Pierce, P.L.C.

(57) ABSTRACT

A flush toilet includes a bowl assembly defining a bowl. The bowl assembly has a discharge outlet at a lower end and a ledge circumferentially extending about a substantial portion of the bowl. The bowl has a rear surface that is generally flat and vertical. The rear surface transitions to the ledge as the bowl continues clockwise and counter clockwise from the rear surface. A horizontal dimension of the ledge increases as the ledge continues from the rear surface to a front of the bowl. An angle of the ledge increases as the ledge continues from the rear surface to the front. A maximum slope of the ledge is located proximate the front. A nozzle is mounted to the bowl assembly for pressurizing a source of flush water and delivering the source of flush water to the bowl for rinsing and flushing of the bowl. The nozzle is positioned at a rear portion of the bowl and produces a first flow of water in a first circumferential direction about the bowl and a second flow of water in a second circumferential direction about the bowl. The second circumferential direction is opposite to the first circumferential direction. The ledge cascades the first and second flows of flush water down the bowl as the first and second flows of water move in the first and second circumferential directions, respectively.

12 Claims, 11 Drawing Sheets

FLUSH TOILET WITH IMPROVED FLOW PATTERN

CROSS-REFERENCE TO RELATED APPLICATIONS

This application is a divisional of U.S. patent application Ser. No. 10/540,006 filed on Nov. 14, 2006 now U.S. Pat. No. 7,861,331, which is a National Stage of International Application No. PCT/US2003/038021 filed on Nov. 26, 2003, which claims the benefit of U.S. Provisional Application No. 60/430,130 filed on Nov. 30, 2002. The entire disclosures of each of the above applications are incorporated herein by reference.

FIELD OF THE INVENTION

The present invention relates to waste management systems. More particularly, the present invention relates to a flush toilet. More specifically, but without restriction to the particular embodiment and/or use which is shown and described for purposes of illustration, the present invention pertains to a reduced water consumption flush toilet.

BACKGROUND OF THE INVENTION

Vehicles including recreational vehicles ("RVs"), airplanes, boats, trains, and the like often include toilets for the comfort and convenience of the passengers. The toilets of vehicles must perform under operating conditions that are significantly different from non-transitory toilets conventionally found in homes and businesses ("home toilets"). For example, vehicle toilets are typically required to operate often in a confined area. Additionally, vehicle toilets rely on a source of on-board water for flushing. For the latter reason, vehicle toilets are typically designed to operate with reduced water consumption for water conservation.

The design of vehicle toilets must accommodate the distinct operating conditions and preferably provide the customer with the comforts and customary features associated with home toilets. One example of a vehicle toilet is shown and described in commonly assigned U.S. Pat. No. 5,060,320 which is hereby incorporated by reference as if fully set forth herein. U.S. Pat. No. 5,060,320 discloses a toilet having a foot pedal flush control arrangement including two pedals. One of the pedals opens a toilet bowl discharge outlet and the other pedal supplies flush water to the bowl. The pedals both operate through actuation cables having a wire member slidable within a conduit. The flush water pedal can be independently actuated to partially fill the bowl prior to use of the toilet while the outlet closure member pedal co-acts with the flush water pedal so that upon opening of the bowl outlet, the flush water pedal is depressed providing water to the bowl. The wire members are solid wire members coupled to the pedals for both pull and push operation so that upon a failure of the pedal return mechanism, the pedals can be manually returned closing the bowl outlet and terminating the flow of flush water to the bowl.

While known vehicle toilets, including the toilet disclosed by U.S. Pat. No. 5,060,320, have proven acceptable for their intended applications, there remains a need for continuous improvement in the pertinent art.

SUMMARY OF THE INVENTION

It is an object of the present invention to provide flush toilet for a motor vehicle that has a ball valve for selectively opening and closing a discharge opening of a bowl assembly that is driven by a flexible a cable.

It is another object of the present invention to provide a flush toilet for a motor vehicle that includes a china bowl and a plastic shroud that allows for easy mounting of the bowl to the base.

It is another object of the present invention to provide a flush toilet for a motor vehicle having a china bowl and a plastic shroud that reduces the weight of the flush toilet.

It is a related object of the present invention to provide a flush toilet with a china bowl and a plastic shroud with improved cleanability.

It is another object of the present invention to provide a flush toilet system having a common base and a plastic shroud that provides for an aesthetically pleasing product.

It is another object of the present invention to provide a flush toilet with a shroud for attachment to a china bowl that is easily removed after original installation for cleaning and service.

It is another object of the present invention to provide a flush toilet having a single sealing member that performs the dual functions of sealing a vitreous china bowl to a plastic base and sealing at a waste ball valve.

It is another object of the present invention to provide a flush toilet with a quality flush with a limited amount of water pressure and volume.

In one form, the present invention provides a flush toilet for a motor vehicle having a bowl assembly, a waste ball valve assembly and a water valve assembly. The bowl assembly defines a bowl and a discharge opening at a lower end of the bowl. The waste ball valve assembly is mounted to the flush toilet for selectively opening and closing the discharge opening of the bowl assembly. The water valve assembly delivers a source of flush water to the bowl. The water valve assembly includes a water valve operable in a water valve open condition and a water valve closed condition. The flush toilet further includes a common actuator for controlling both the waste ball valve assembly and the water valve assembly. The common actuator is movable from a first position to an intermediate position and from the intermediate position. In the first position the waste ball valve assembly closes the discharge opening and the water valve assembly is in the closed condition. In the intermediate position the waste ball valve assembly closes the discharge opening and the water valve assembly is in the open position for adding water to the bowl. In the second position the waste ball valve assembly opens the discharge opening and the water valve assembly is in the open position for flushing the bowl.

In another form, the present invention provides a flush toilet for a motor vehicle having a bowl assembly, a waste ball valve assembly and a water valve assembly. The bowl assembly defines a bowl and a discharge opening at a lower end of the bowl. The waste ball valve assembly is mounted to the flush toilet for selectively opening and closing the discharge opening of the bowl assembly. The water valve assembly selectively delivers a source of flush water to the bowl. The water valve assembly includes a water valve operable in a water valve open condition and a water valve closed condition. An actuator controls the waste ball valve assembly and is interconnected to the waste ball valve assembly by a flexible cable. The actuator is movable from a first position to second position for selectively opening the discharge opening.

In another form, the present invention provides a reduced water consumption flush toilet including a bowl assembly defining a bowl having a discharge outlet at a lower end and a ledge circumferentially extending about a substantial portion of the bowl. The flush toilet includes a nozzle mounted to the bowl assembly for pressurizing a source of flush water and delivering the source of flush water to the bowl for rinsing and flushing of the bowl. The nozzle is positioned at a rear portion of the bowl and operatives to produce a first flow of water in a first circumferential direction about the bowl and a second flow of water in a second circumferential direction about the bowl, the second circumferential direction being opposite to the first circumferential direction. The ledge cascades the first and second flows of flush water down the bowl as the first and second flows of water move in the first and second circumferential directions, respectively.

In yet another form, the present invention provides a flush toilet including a base and a bowl assembly defining a bowl. The bowl assembly is mounted to the base and defines a discharge opening at a lower end of the bowl. A waste ball valve assembly is mounted to the flush toilet for selectively opening and closing the discharge opening of the bowl assembly. A common sealing member seals the bowl to the base and wipes a ball of the ball valve assembly as the waste ball valve assembly is selectively opened and closed.

In still yet another form, the present invention provides a flush toilet including a bowl assembly defining a bowl, a base downwardly extending from the bowl assembly and a shroud removable attached to the toilet. The shroud peripherally surrounding at least a portion of the bowl assembly or at least a portion of the base.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
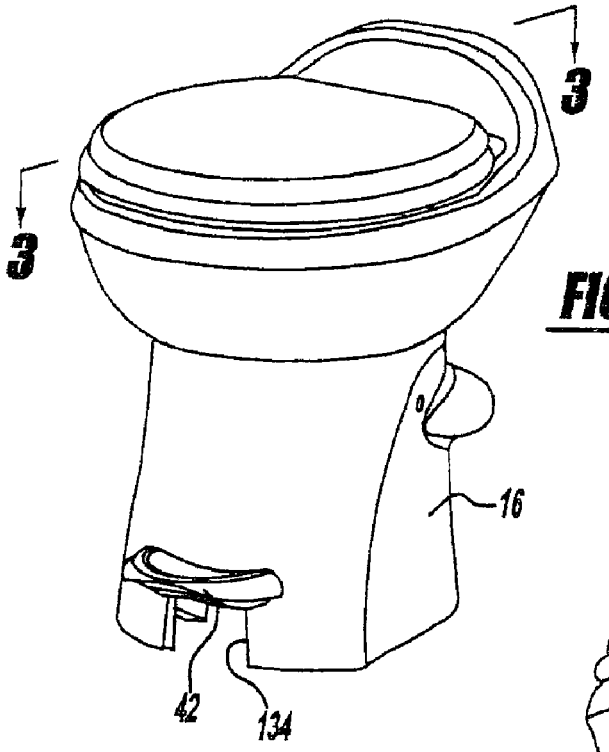
FIG. 1 is a front perspective view of a flush toilet constructed in accordance with the teachings of a first preferred embodiment of the present invention.

The following description of the preferred apparatus of the present invention is merely exemplary in nature and is in no way intended to limit the invention, its application, or uses.

With reference to FIGS. 1-13 of the drawings, a flush toilet constructed according to the teachings of a first embodiment of the present invention is illustrated and generally identified at reference character 10. In one particular application, the flush toilet 10 is intended for use within a motor vehicle such as a recreational vehicle or the like. After a reading of the remainder of this detailed description, however, those skilled in the art will readily appreciate that the teachings of the present invention are not limited to this exemplary application. Rather, various of the teachings of the present invention have applicability to other vehicle and non-vehicle applications.

The flush toilet 10 of the present invention is illustrated as what is known as a high rise toilet and is generally shown to include a bowl assembly 12 and a base or housing 14. Alternatively, the flush toilet 10 can be constructed as a low rise toilet that is mounted on a platform. The bowl assembly 12 is constructed of a vitreous china. The base 14 is constructed of a plastic. As will be addressed below, a shroud or shroud 16 surrounds the base 14 and provides an improved aesthetic appearance for the toilet 10.

With particular reference to the cross-sectional views of FIGS. 3 through 5, the geometry of the bowl assembly 12 insofar as it relates to the present invention will be described. As will become more apparent below, the bowl assembly 12 has a unique geometry that cooperates with a nozzle 32 to provide for improved rinsing and flushing. The toilet 10 of the present invention is particularly intended, but not exclusively limited for motor vehicle applications. Such applications are expected to receive a wide range of incoming water pressures depending on the particular source of flush water. In the particular embodiment illustrated, the pressure of the incoming flush water is not dynamically controlled. It is important that the bowl geometry and the nozzle 32 cooperatively function to provide an adequate rinse and flush at lower water pressures and also cooperatively function to prevent water from splashing from the toilet 10 at higher water pressures.

The bowl assembly 12 is shown to include at its lower end a discharge outlet 20 defined by a downwardly projecting portion 22. The upper end of the bowl assembly 12 is open to define a bowl 24. A lower end of the bowl assembly is mounted to the base 14. The bowl assembly 12 is bolted or otherwise securely fastened to the base 14 in any manner well known in the art.

The bowl assembly 12 of the flush toilet 10 is constructed to include a rim 26 and a ledge 27. The rim 26 includes an upper surface 28 and a downwardly extending flange 30. The rim 26 provides protection against splashing of water outside of the unit and provides a more "home-like" appearance. In the embodiment illustrated, the rim 26 is a separately constructed piece that is bonded to a lower portion of the bowl assembly 12.

Figure 4:
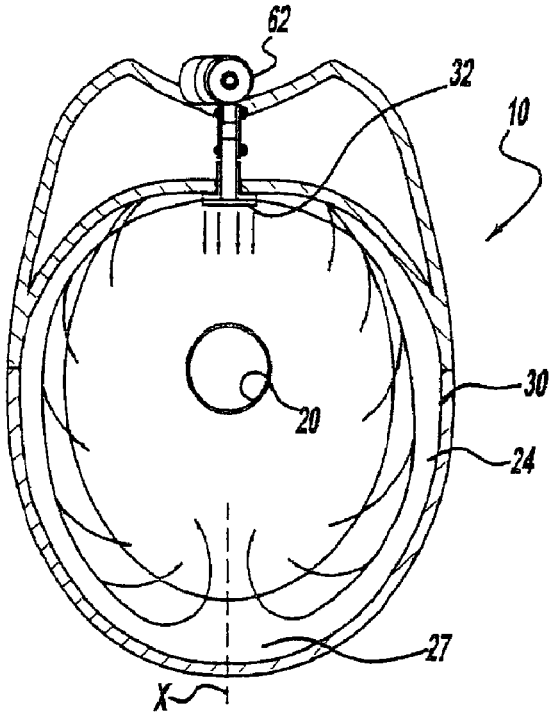
FIG. 4 is a cross-sectional view taken along the line 4-4 of FIG. 3.
Figure 3:
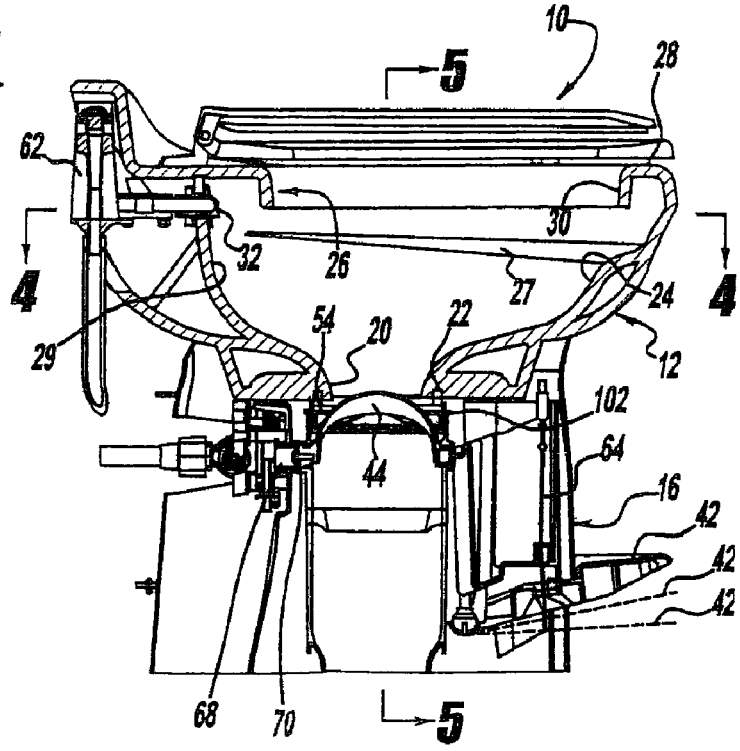
FIG. 3 is a cross-sectional view taken along the line 3-3 of FIG. 1.

The ledge 27 of the bowl assembly 12 is shown most clearly in FIGS. 3 and 4. The bowl 24 defines a generally flat and generally vertical surface 29 (see FIG. 3, for example) immediately adjacent the nozzle 32. This generally vertical surface 29 transitions into the ledge 27 as the bowl 24 continues in both a clockwise and a counterclockwise direction. Reference to clockwise and counterclockwise directions will be understood to be in relationship to the top view of FIG. 4. The horizontal width of the ledge 27 increases as the ledge continues from the generally vertical surface 29 to the front of the bowl 24. The angle of the ledge 27 increases as the ledge continues from adjacent the generally vertical surface 29 to the front of the bowl 24. In this regard, the maximum slope of the ledge 27 is located at the front of the bowl 24.

In a manner to be discussed more fully below, the nozzle 32 provides a source of flush water and is positioned below the rim 26. The nozzle 32 includes a plurality of holes that cooperates with the rim 26 and the ledge 27 to create an improved flushing or rinsing action by distributing flush water around the rim 26. The symbiotic relationship between the ledge 27 and the nozzle pattern provides improved rinsing and flushing action for low water consumption applications.

Figure 8:
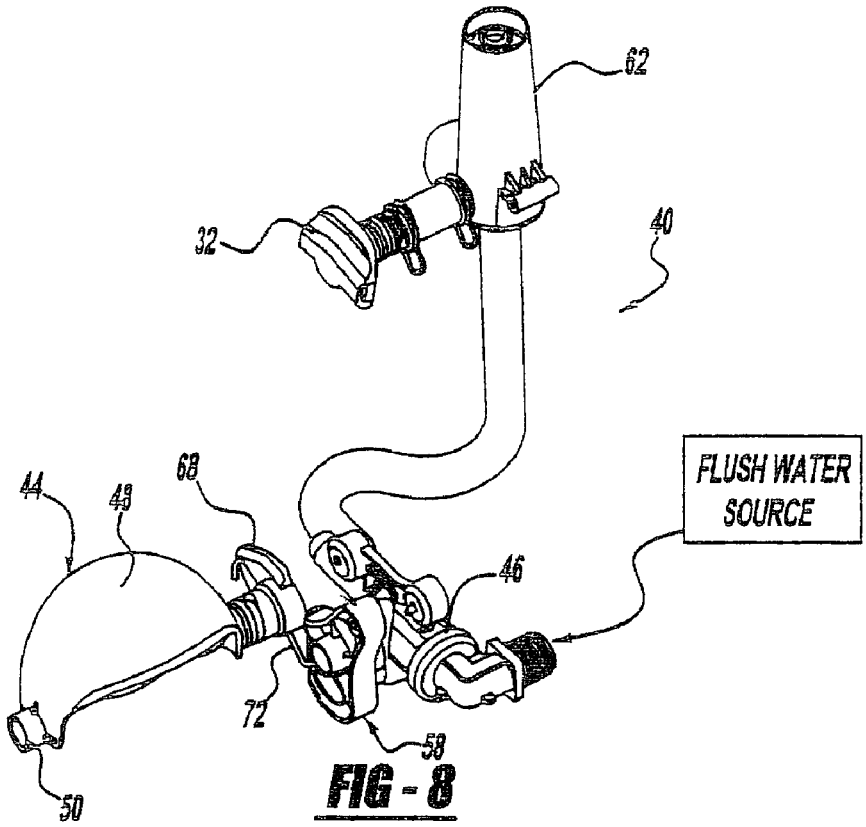
FIG. 8 is a perspective view of the flush arrangement of the flush toilet of FIG. 1.

With continued reference to the cross-sectional views of FIGS. 3 through 5 and additional reference to the exploded view of FIG. 8, a flush arrangement 40 of the flush toilet 10 of the present invention will be described. In the embodiment illustrated, the flush arrangement 40 is controlled by a single actuator. In the embodiment illustrated, the actuator is a foot actuated lever 42.

The foot actuated lever 42 is movable from a first position (as shown in FIGS. 1 and 3, for example) to a second position (identified in the drawings in simple phantom lines in FIG. 3 at reference character 42") downwardly pivoted about 25° from the first position. As will be more further discussed below, articulation of the lever 42 from the first position to an intermediate position functions to add water to the bowl 24 without opening the discharge opening 20. The intermediate position is identified in the drawings in simple phantom lines in FIG. 3 at reference character 42'. Continued articulation from the intermediate position to the second position functions to selectively open the discharge opening 20 of the bowl assembly 12 and functions to selectively deliver a source of flush water to the bowl 24 of the bowl assembly 12 for flushing. It will be appreciated by those skilled in that art that various teachings of the present invention may alternatively be employed with a hand actuated lever or an electronically controlled arrangement.

The flush arrangement 40 is illustrated to generally include a waste ball valve assembly 44 and a water valve assembly 46. In a manner to be discussed, the waste ball valve assembly 44 is operative to selectively open and close the discharge opening 20 of the bowl assembly 12. The water valve assembly 46 is operative for selectively delivering a source of flush water to the bowl 24 for rinsing and flushing.

As will become more apparent below, the flush arrangement 40 of the flush toilet 10 allows the foot actuated lever 42 to be conveniently positioned at the front of the flush toilet 10 and the water valve assembly 46 to be positioned at the rear of the flush toilet 10. The waste valve assembly 44 includes a central portion 44 and first and second ends 50 and 52. The central portion 48 is spherical in shape and in a manner to become more apparent below cooperates with a seal member 54 for selectively opening and closing the discharge opening 20. The first and second ends 50 and 52 of the waste valve assembly 44 are generally cylindrical in shape and are rotatably received in cooperating cylindrical apertures defined by the housing 14. As such, the central portion 48 is rotatable between open and closed positions about an axis extending through the first and second cylindrical ends 50 and 52.

Opening and closing of the water valve assembly 46 is controlled by a water valve drive arm 58. The water valve drive arm 58 is rotatably mounted to the housing 14 and includes a main body portion 59 and a valve member 60. A snap ring 61 and an O-ring 63 are positioned between the main body 59 and the valve member 60. In this regard, a splined extension 65 of the main body 59 passes through the snap ring 61 and the O-ring 63 and engages an aperture of the valve member 60.

Figure 11A:
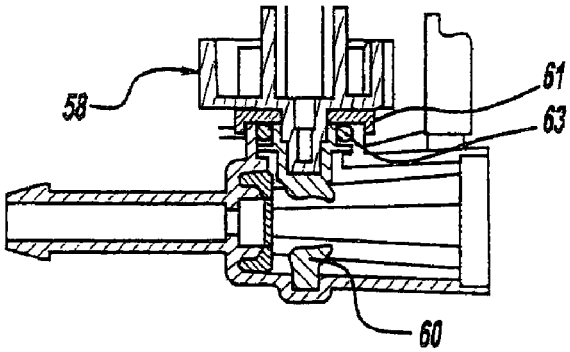
FIGS. 11A and 11B are cross-section views of the water valve assembly of the flush toilet of FIG. 1, illustrating the water valve assembly in an open condition and a closed condition, respectively.
Figure 11B:
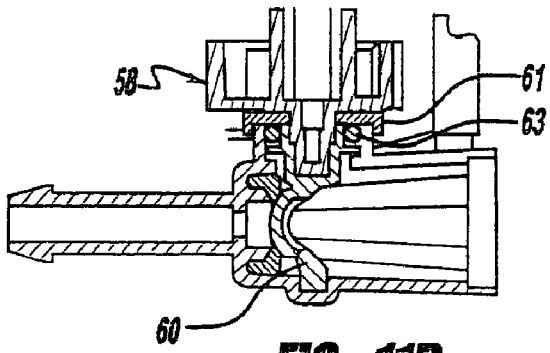

As shown in FIGS. 11A and 11B, the valve member 60 extends into the water valve assembly 46 and functions to selectively open and close a water path for the delivery of flush water to the bowl 24. FIG. 11A illustrates the valve member 60 rotated to a first position in which the water valve assembly 46 is in an open condition. FIG. 11B illustrates the valve member 60 rotated to a second position in which the water valve assembly is in a closed condition. In the open condition, flush water passes through the water valve assembly 46 to a breaker assembly 62 and in turn to the nozzle 32.

The water valve drive arm 58 is connected to the foot actuated lever 42 by a flexible cable 64. The cable 64 provides flexibility for relative positioning of the lever 42 and the remainder of the flush arrangement 40. In this regard, prior art arrangements incorporating a ball valve require the actuating member and the ball valve to rotate about parallel (if no coincident) axes. As such, conventional placement of the lever and flush arrangement has been limited.

Figure 5:
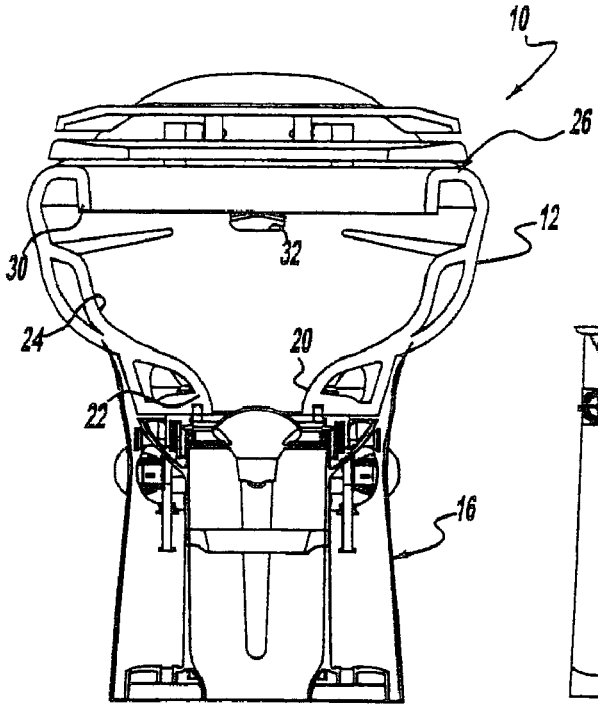
FIG. 5 is a cross-sectional view taken along the line 5-5 of FIG. 3.
Figure 6A:
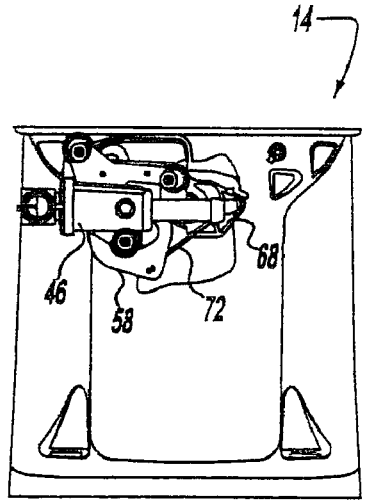
FIGS. 6A-6C represent a series of views of the base of the flush toilet of FIG. 1 illustrating the water valve drive arm as it rotates from a closed position (FIG. 6A), to a water-add position (FIG. 6B), and to a flush position (FIG. 6C).
Figure 6B:
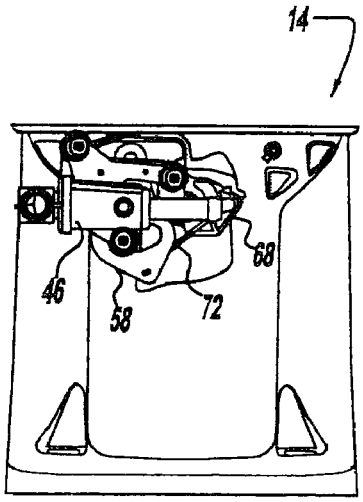
Figure 6C:
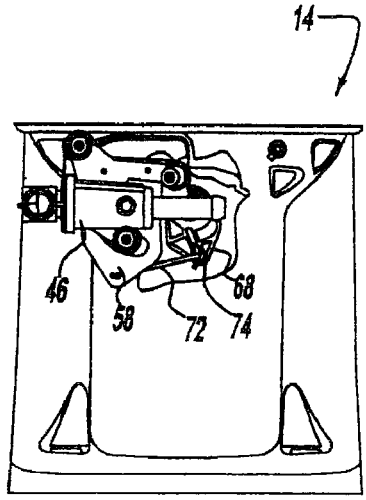

A first end of the cable 64 is coupled to the foot actuated lever 42 (see FIG. 5). A second end of the cable 64 is coupled to the water valve drive arm 58 (see FIG. 8, for example). When the foot actuated lever 42 is rotated from the first position to the intermediate position, the water valve drive arm 58 is rotated through approximately 5-10 degrees. This initial rotation of the water valve drive arm 58 is shown in FIG. 6B, for example, and rotates the valve member 60 to open the water valve assembly 46 for adding water to the bowl 24.

The waste valve assembly 44 is driven by a waste valve drive arm 68. The waste valve drive arm 68 is mounted to the waste valve assembly 44 by a fastener 70 for common rotation. The fastener 70 engages an aperture 71 in the end 52. The second end 52 and waste valve drive arm 68 are provided with cooperating structure to prevent relative rotation therebetween.

The waste valve drive arm 68 is coupled to the water valve drive arm 58 through a lost motion connection. More particularly in this regard, the waste valve drive arm 68 is connected to the water valve drive arm 58 by a link 72. A first end of the link 72 is received by an aperture 73 of the water valve drive arm 58. A second end of the link 72 is slidably received within a slot 74 defined by the waste valve drive arm 68. When the foot actuated lever 42 is rotated from the first position to the intermediate position, the second end of the link 72 transitions from one end of the slot 74 to the other end of the slot without rotating the waste valve drive arm 68. When the foot actuated lever 42 is rotated from the intermediate position to the second position, continued rotation of the water valve drive arm 58 causes corresponding rotation of the waste valve drive arm 68. This rotation of the waste valve drive arm 68 in turn rotates the waste valve assembly 44 for opening of the discharge opening 20. In this position, the water valve assembly 46 remains open for delivering the source of flush water to the bowl 24 for flushing of the bowl 24.

Figure 12:
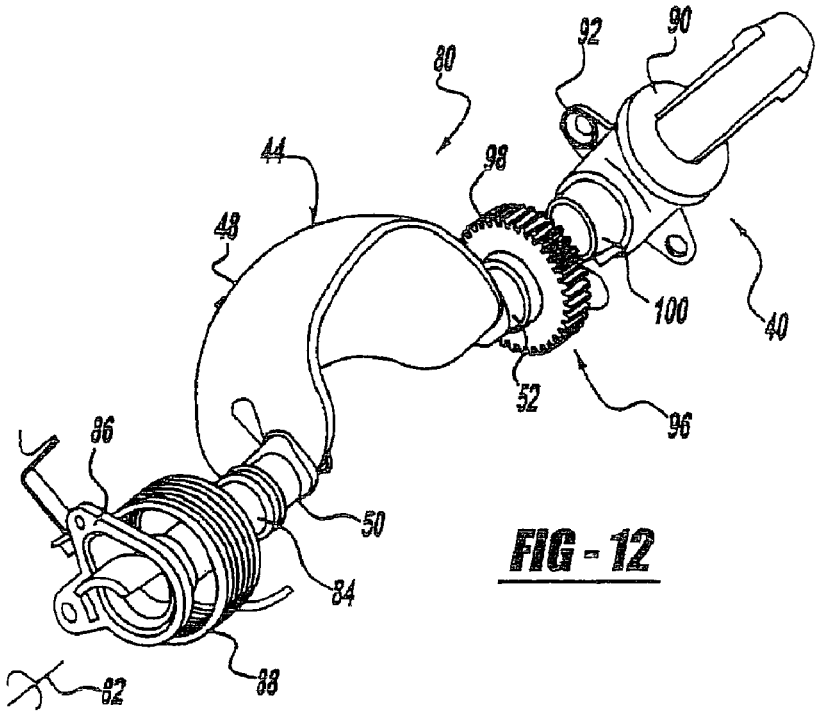
FIG. 12 is an alternative flush arrangement of the flush toilet of FIG. 1.
Figure 9:
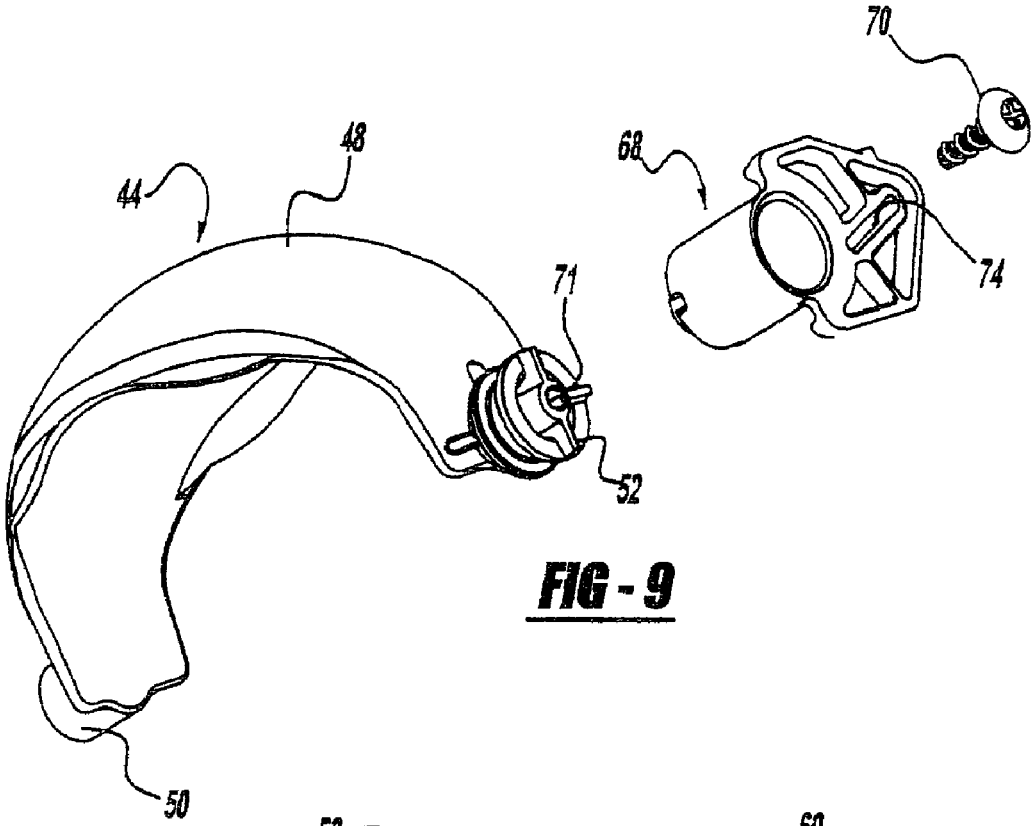
FIG. 9 is an exploded perspective view illustrating the waste valve assembly and the waste valve drive arm of the flush arrangement of the flush toilet of FIG. 1.
Figure 10:
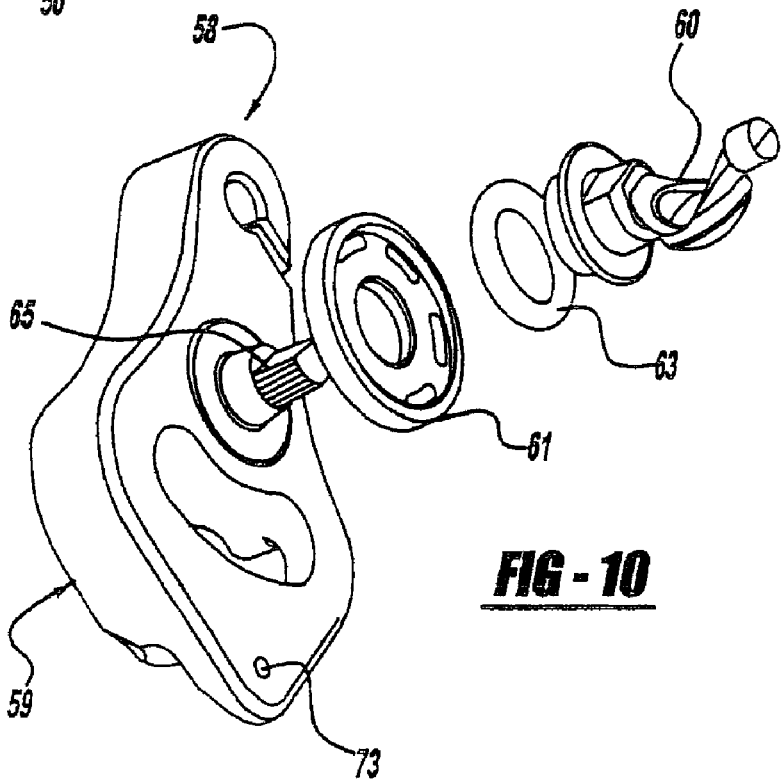
FIG. 10 is an exploded perspective view of the water valve drive arm of the flush arrangement of the flush toilet of FIG. 1.

Turning now to the perspective view of FIG. 12, an alternative flush assembly of the present invention is illustrated and generally identified at reference character 80. Various components are also common between the flush assemblies. For this reason, like reference numbers are used with reference to FIG. 12 to denote like components previously discussed. The alternative flush assembly of FIG. 12 again includes a waste valve assembly 44 having a central portion 48 that is partially spherical in shape and is mounted to the base 14 for rotation about an axis. The waste valve assembly 44 rotates in a direction A from a waste valve open position (as shown in FIG. 12) to a waste valve closed position (not specifically shown).

A first end 50 of the waste valve assembly 44 is coupled to an input shaft 84. An end of the input shaft 84 is coupled to the foot actuated lever 42 through a camming member 86. The camming member 86 converts approximately 25 degrees of lever 42 articulation to approximately 105 degrees of waste valve assembly 44 rotation. Through this rotation, the waste valve assembly 44 is articulated between its closed and open positions. A spring 88 functions to bias the waste valve assembly 44 to its closed position and also functions to bias the lever 42 to its first or upper position.

A second end 52 of the waste valve assembly 44 opposite the input shaft 84 is interconnected the water valve assembly 46 such that rotation of the waste valve assembly 44 from its closed position to its open position moves the water valve assembly 46 from a closed condition to an open condition. The water valve assembly 46 is shown to generally include a water valve fitting 90 and a water valve body 92. The water valve body 92 houses a ball valve (not specifically shown) that is movable between an open position and a closed position. Insofar as the present invention is concerned, the water ball valve is otherwise conventional in construction.

In the embodiment illustrated, the water valve assembly 46 is indirectly connected to the waste valve assembly 44 through a gear arrangement 96. The gear arrangement 96 is shown to include a first or waste gear 98 meshingly engaged with a second or water gear 100. The gear reduction provided by the gearing arrangement 96 allows the water valve to rotate through a lesser degree as compared to the waste ball valve assembly 44.

In the illustrated embodiment, an initial rotation of the waste ball valve assembly 44 through approximately 15 degrees does not function to open the discharge opening 106 of the bowl assembly 12. However, the water valve is opened for purposes of delivering flush water to the bowl 24. Further rotation of the waste ball valve assembly 44 functions to open the discharge opening 20 and continue to deliver flush water to the bowl 24. In this manner, additional flush water can be delivered to the bowl 24 as desired through partial rotation of the lever 42 from the first position.

With particular reference to the cross-sectional views of FIGS. 3 through 5 and FIG. 13, the seal member 54 of the present invention will be described. As will become understood by those skilled in the art, the seal member 54 provides a single element that performs the function of sealing a vitreous china bowl 24 to a plastic base 14 and also performs the function of sealing at a waste ball valve assembly 44. The sealing member 54 also functions to wipe the waste ball valve assembly 44 as the waste ball valve assembly 44 is moved from its closed position to its open position.

The seal member 54 is retained in the housing 14 by a retaining member 102. The seal member 54 is toroidal in shape and defines a central opening 104. The central opening 104 tapers in an upward direction to facilitate mating engagement with the central portion 48 of the waste ball valve assembly 44. The seal member 54 includes an upwardly extending cylindrical flange 106 and a lower, generally horizontal portion 108. In one particular embodiment, the upwardly extending cylindrical flange 106 is constructed a compressible foam rubber and the lower, generally horizontal portion 108 is constructed of generally incompressible solid rubber. The upper and lower portions 106 and 108 are laminated to one another.

Figure 13:
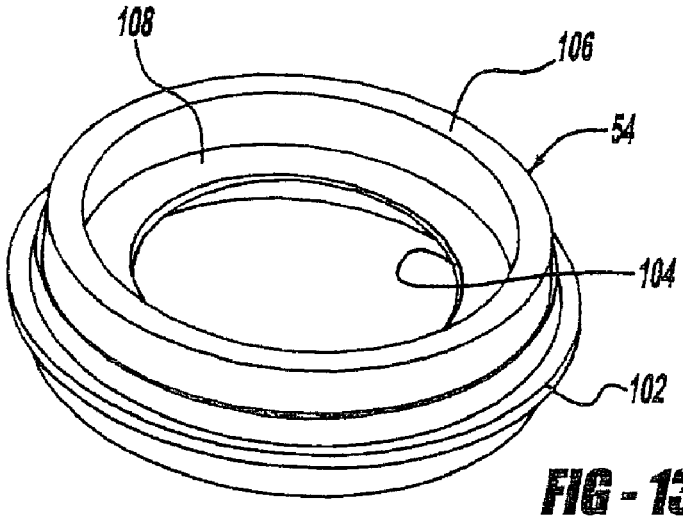
FIG. 13 is a perspective view of a seal member and seal retainer of the flush toilet of FIG. 1.
Figure 13A:
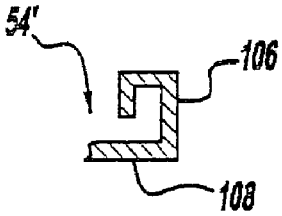

FIG. 13A illustrated an alternative seal member 54' that is injection or compression molded of a common rubber material. The material of the seal member 54' is a relatively incompressible rubber. Many suitable materials are well known in the art. The upper portion 106 of the seal member 54' is shown to include an open cross section to maintain the compressibility of the seal member 54' in a vertical direction.

The upwardly extending cylindrical flange 106 is compressed between the bowl assembly 12 and the base 14 and provides a water-tight seal between the bowl assembly 12 and the base 14. Thus, a single seal member 54 performs the dual functions of sealing the vitreous china bowl assembly 12 to a plastic base 14 and sealing/wiping at a ball valve assembly 44. The horizontal portion 108 engages the waste ball valve assembly 44 and maintains contact with the central portion 48 of the waste ball valve assembly 44 throughout its rotation. In this manner, the seal member 54 provides an improved wiping action to remove waste from the waste ball valve assembly 44.

In certain applications it may be desirable to treat the lower surface of the lower portion 108 of the seal member to reduce the effective coefficient of friction. Such a reduction of the coefficient of friction may further facilitate wiping of the central portion 48 of the waste ball valve assembly 44. In one application, the lower surface of the lower portion 108 is coated with Teflon. In another application, the lower surface of the lower portion 108 is chlorinated. Other materials or treatments may be used within the scope of the present invention to reduce the coefficient of friction.

The seal retainer 102 provides relative positioning of the seal member 54 to the central portion 48 of the waste ball valve assembly 44. The seal retainer 102 also provides a surface against which the seal member 54 may be vertically compressed for sealing the vitreous china bowl assembly 12 to the plastic base 14. In certain applications, the seal member 54 can be over-molded of a thermoplastic material directly to the retainer 102.

Incorporation of a single element to seal the bowl assembly 12 relative to the base 14 and to seal the bowl assembly 12 relative to the waste ball valve assembly 44 eliminates errors in assembly that may otherwise result. In this regard, seal arrangements known in the art that incorporate two separate seals are frequently assembled with the wrong seal on top. Additionally, the seals of conventional arrangements are often put in upside down.

Figure 7:
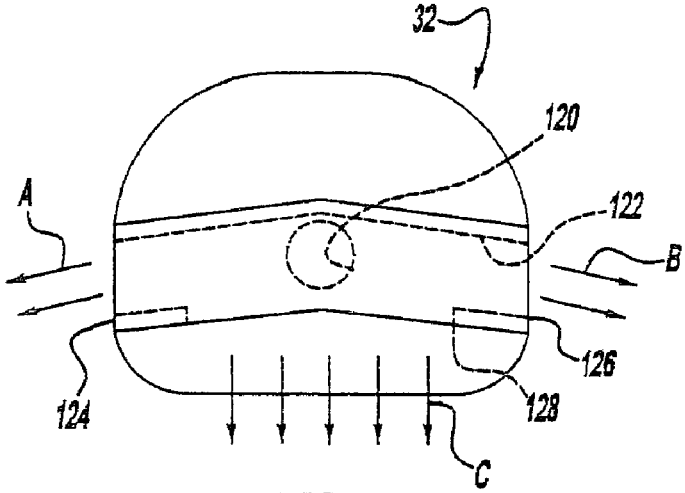
FIG. 7 is an enlarged front view of the nozzle of the flush toilet of FIG. 1 illustrating flow from the nozzle.

With particular reference to the cross-sectional view of FIG. 4 also to FIG. 7, the flow created for flushing of the bowl 24 by the nozzle 32 will be further described. The nozzle 32 restricts the flow of the flush water and thereby pressurizes the flush water for flushing or rinsing action. In the particular embodiment illustrated, the nozzle 32 includes a single inlet port 120 and functions to divert water in three general directions. As shown in FIG. 7, the nozzle 32 defines a laterally extending channel 122. The opposing sides of the channel 122 angle slightly downward from a lateral center of the nozzle 32. First and second ends 124 and 126 of the nozzle 32 are open for creating first and second flows of water A and B, respectively. Due to the geometry of the channel 122, the first and second flows A and B are correspondingly angled slightly downward. An opening 128 in a lower side of the channel 122 provides for a third flow of water C. In one particular application, water dispersed from the nozzle 32 is regulated to a rate of approximately 2.5 gallons per minute. In this application, the flow of water is allocated approximately as follows: A=35%; B=35%; and C=30%.

As diagrammatically shown in the cross-sectional view of FIG. 4, the flows A, B, and C from the nozzle 32 create a flush pattern for full coverage of the bowl 24. The nozzle 32 pressurizes the water and the rim 26 provides protection against splashing. The water flows A and B define a symmetrical pattern and converge at an imaginary line X that passes through the nozzle and the front of the bowl 24 directly opposite the nozzle 32. The increasing horizontal width of the ledge 27 and the increasing slope of the ledge 27 as the ledge continues from adjacent the generally vertical surface 29 causes the water flows A and B to gradually cascade downward from opposing directions as they progress toward the front of the bowl 24. In this manner, water from flow A and flow B is under enough pressure even under lower pressure conditions to provide complete wetting of the bowl 24.

Figure 2:
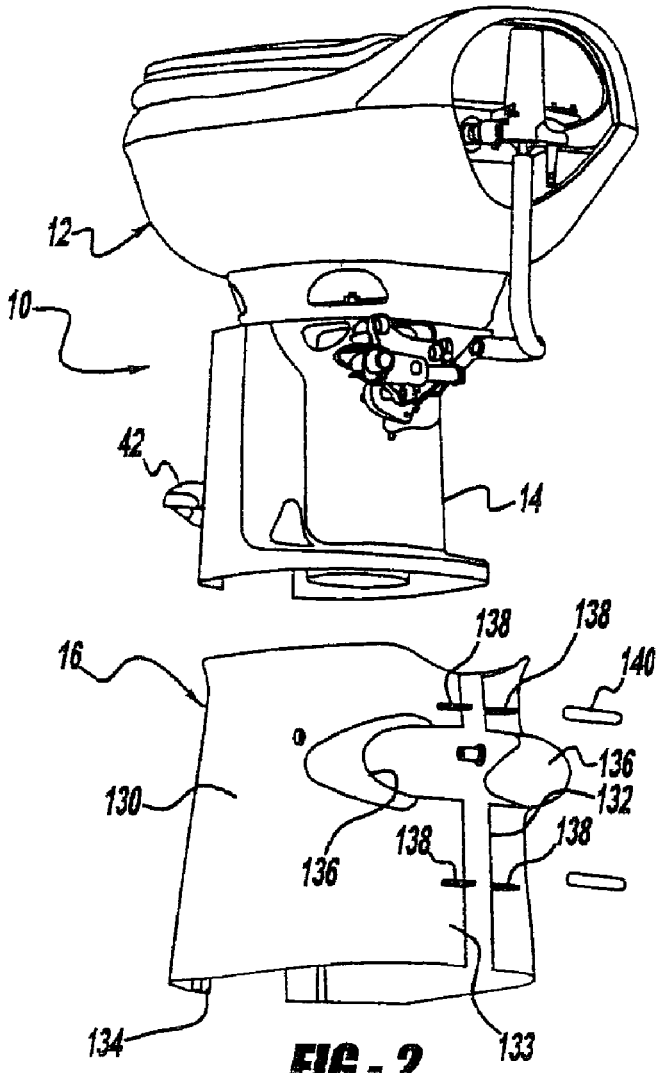
FIG. 2 is a rear perspective view of the flush toilet of FIG. 1 shown partially exploded.

With particular reference to FIGS. 1 and 2, the shroud will be further described. In the embodiment illustrated, the shroud 16 is integrally molded of a plastic material. In one particular application, the shroud is constructed of TPO or other suitable plastic material. Incorporation of a compliant material allows for variable fit to the bowl assembly 14 to accommodate for vitreous china processing tolerances.

In one application, the shroud 16 is constructed of a composite material including a microbacterial agent. For example, the composite material may include an antimicrobial biocidic. The composite material would be capable of killing bacteria on contact.

The shroud 16 is illustrated to include a side wall 130 that wraps around the base 14 of the toilet 10. As perhaps shown most clearly in the exploded view of FIG. 2, the side wall 130 has two ends 132 and 133 that terminate at a vertically extending centerline. The resilient nature of the shroud 16 allows the ends 132 and 133 to be separated sufficiently from one another for attachment to or removal from the base 14. A lower portion of a front side of the shroud 16 is shown to include a cut-out 132. The cut-out 34 accommodates the lever 18. A rear side of the shroud 16 is formed to include a pair of flanges that accommodate the water valve assembly 40. The plastic material of the shroud 16 reduces the china material required while maintaining an aesthetically pleasing appearance. In this manner, the weight of the toilet 10 is reduced approximately 2.5-4.0 pounds.

The shroud 16 is integrally formed to include two pairs of flanges 138. An upper pair of flanges 138 align with one another and receive an elastic member in the form of an O-ring 140 for securing the first and second ends 132 and 133 of the sidewall 130. A lower pair of the flanges 138 similarly align with one another and receive an O-ring 140 for further securing the first and second ends 132 and 133. Removal of the O-rings 138 allows the shroud 16 to be easily removed from the remainder of the toilet 10 for cleaning or replacement.

Figure 14:
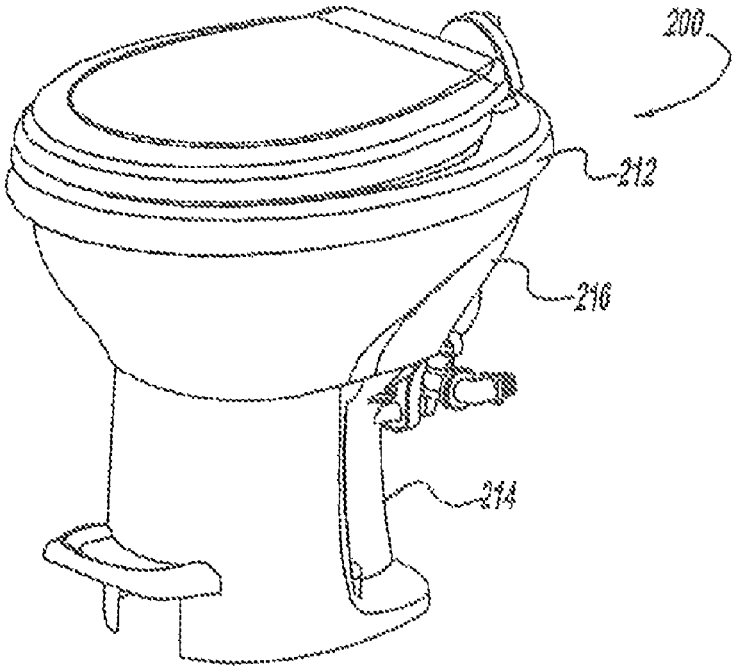
FIG. 14 is a front perspective view of a flush toilet constructed in accordance with the teachings of a second embodiment of the present invention.

Turning now to FIGS. 14 though 20, a flush toilet constructed in accordance with a second embodiment of the present invention is illustrated and generally identified at reference character 200. Various elements of the toilet 200 of the second embodiment are common with the toilet 10 of the first embodiment described above. Principally in this regard, the flush arrangement 40 and seal member 54 are common between the two embodiments. For this reason, these features need not be particularly described with respect to the second embodiment.

The flush toilet 200 is illustrated to generally include a bowl assembly 212 and a base or housing 214. The bowl assembly 212 is constructed of a vitreous china. The base 214 is constructed of plastic. A shroud or wrap 216 surrounds an outer portion of the bowl assembly 212.

The bowl assembly 212 is shown to include at its lower end a discharge outlet or opening 220. The discharge outlet 220 is defined by a downwardly projecting portion 222. The upper end of the bowl assembly 212 is open to define a bowl 224. The bowl assembly 212 is bolted or otherwise suitable securely fastened to the base 214 in any well known manner in the art.

The bowl assembly 212 of the flush toilet 200 is constructed without a rim (i.e., the bowl assembly 212 has an open-bowl design). Rather, the bowl assembly 212 includes an upper surface 228 and a downwardly extending flange 230. As will become more apparent below, an upper edge of the shroud 216 is received between the downwardly extending flange 230 and the sidewall of the bowl assembly 212.

Figure 15:
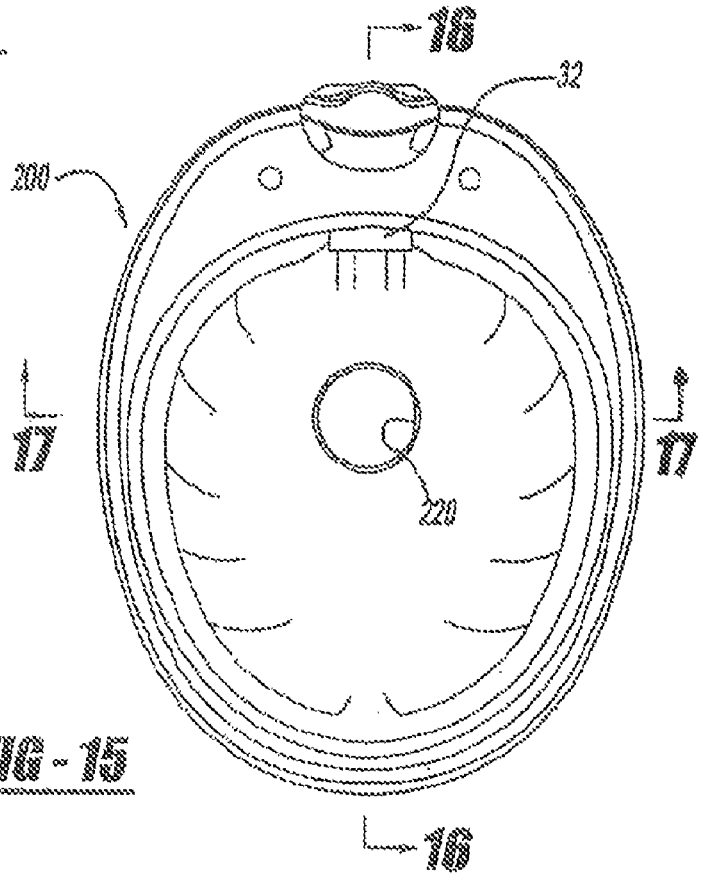
FIG. 15 is a top view of the flush toilet of FIG. 1 shown with the seat and lid removed for purposes of illustration.
Figure 16:
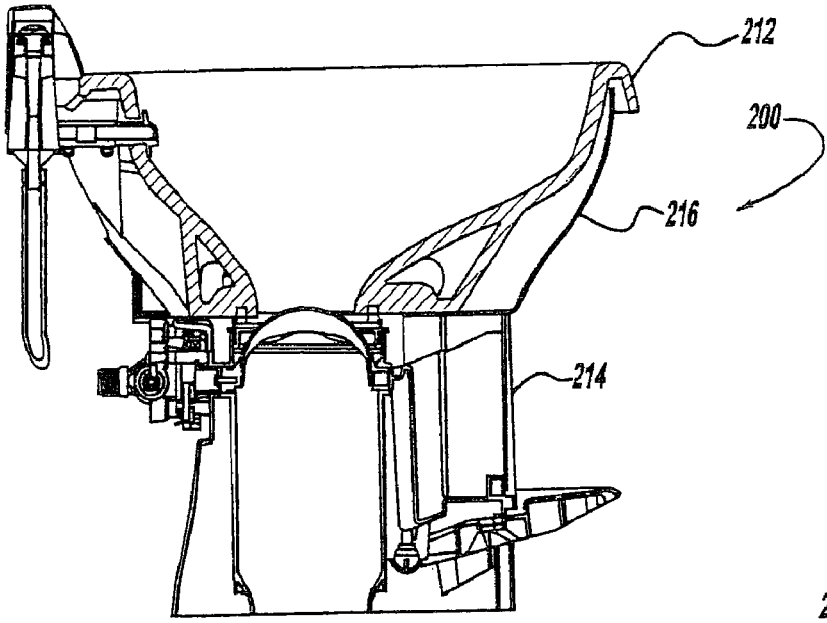
FIG. 16 is a cross-sectional view taken along the line 16-16 of FIG. 15.
Figure 17:
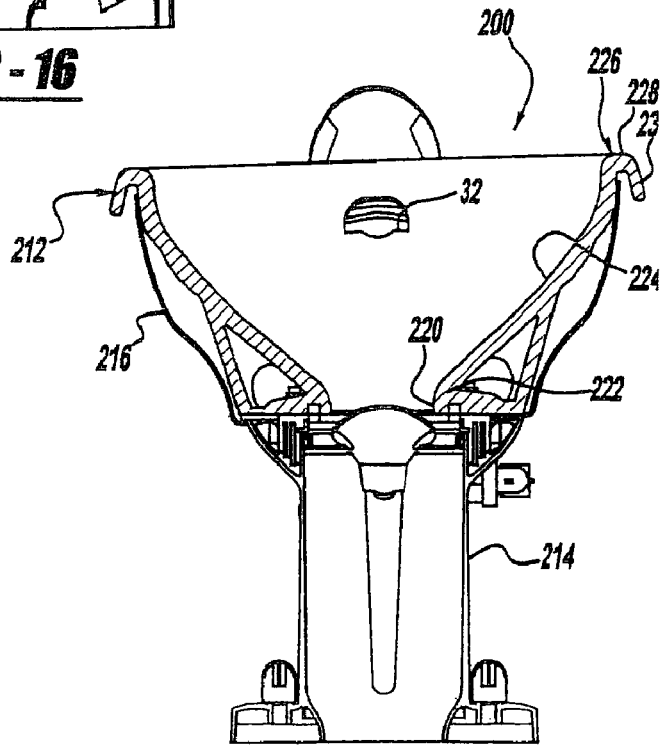
FIG. 17 is a cross-sectional view taken along the line 17-17 of FIG. 15.

FIGS. 15 and 17 illustrate the toilet 200 to include a nozzle 32 similar to the nozzle discussed above. As such, the nozzle generally creates the symmetrical water pattern discussed above. Use of the nozzle 32 with the open-bowl design of the bowl assembly 212 may require dynamic flow control of the source of flush water. In this regard, it may be necessary in certain applications to dynamically restrict to flow of flush water to the nozzle 32 to a predetermined maximum pressure to prevent splashing from the bowl 224. Such dynamic flow control will be understood to be conventional insofar as the present invention is concerned. One suitable type of dynamic flow control is commercially available from Thetford Corporation with its toilets sold under the Aurora® trademark.

Figure 19:
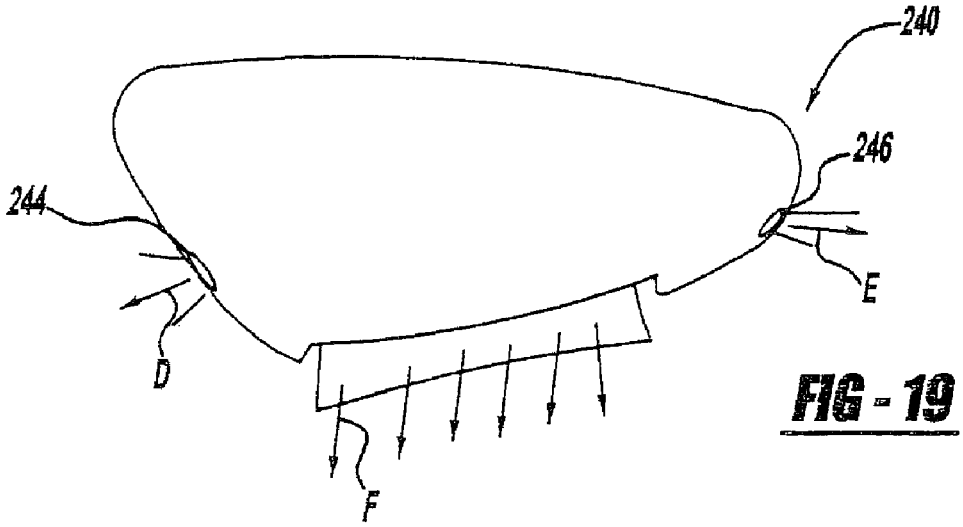
FIG. 19 is a front view of the nozzle of the flush toilet of FIG. 14.
Figure 20:
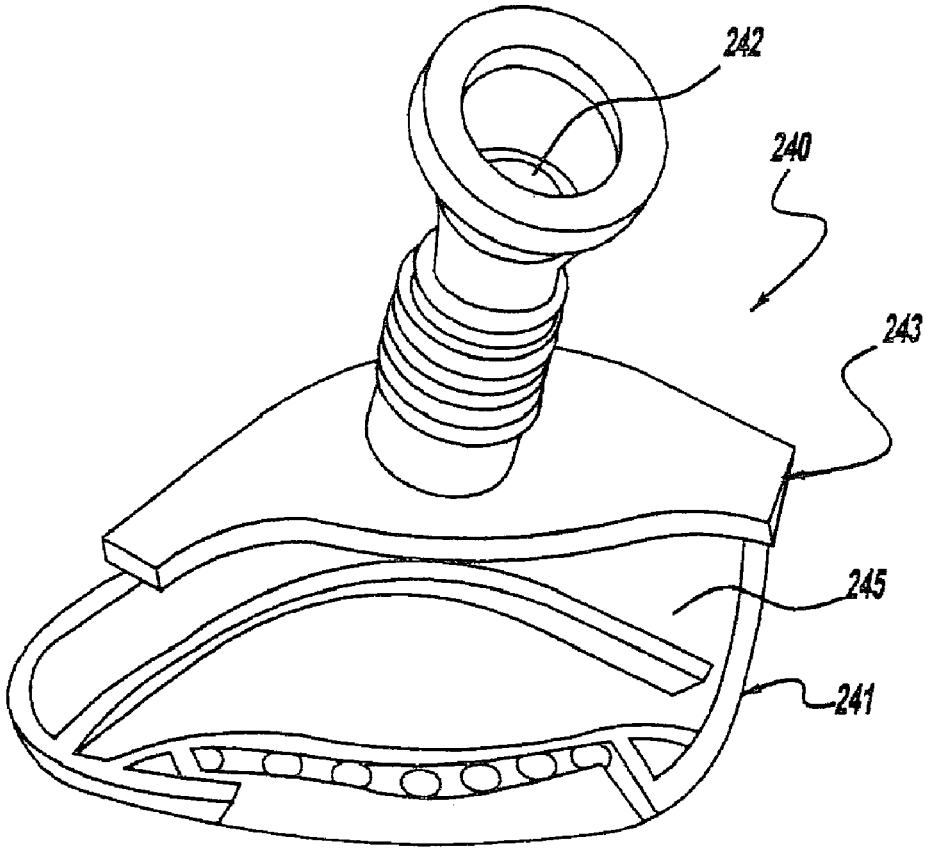
FIG. 20 is an exploded, rear perspective view of the nozzle of the flush toilet of FIG. 14.
Figure 21:
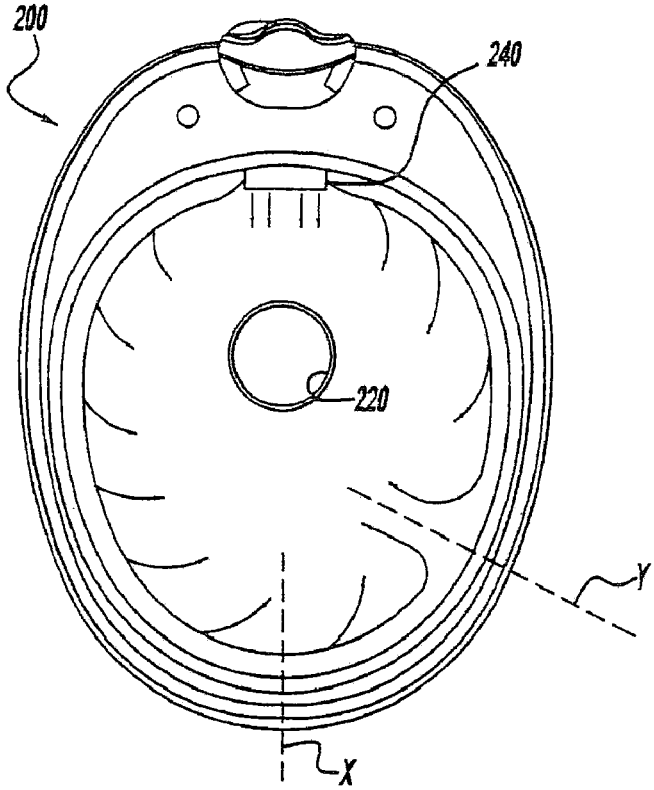
FIG. 21 is a view similar to FIG. 15 illustrating the flow characteristics of the nozzle of FIGS. 19 and 20.

Turning to FIGS. 19 through 21, an alternative nozzle 240 for use with the toilet 200 will be described. As will become more apparent below, the nozzle 240 is operative for creating an asymmetrical pattern. In certain applications, the nozzle 240 may be used with the open-bowl design of the bowl assembly 224 without the need for dynamic flow control.

The nozzle 240 is generally illustrated to include a front component 241 and a rear component 243. The components 241 and 243 are registered and fastened together. The nozzle 240 restricts the flow of the flush water and thereby pressurizes the flush water for flushing or rinsing action. In the particular embodiment illustrated, the nozzle 240 includes a single inlet port 242 integrally formed with the component 243. The components 241 and 243 cooperate to direct water in three general directions. As shown in FIG. 19, the nozzle 240 defines a generally, laterally extending channel 245. The opposing sides of the channel 245 angle slightly downward from a lateral center of the nozzle 240. First and second ends 244 and 246 of the nozzle 240 are open for creating first and second flows of water D and E, respectively. Due to the geometry of the channel 245, the first and second flows D and E are correspondingly angled slightly downward. A plurality of openings 248 in a lower side of the channel 245 provides for a third flow of water F. In one particular application, the flow of water creates an asymmetrical pattern and is allocated approximately as follows: D=50%; E=20%; and F=30%.

As diagrammatically shown in the top view of FIG. 21, the flows D, E, and F from the nozzle 240 create a flush pattern for full coverage of the bowl 224. The nozzle 240 pressurizes the flush water and the water flows D and E create the asymmetrical pattern that converges at an imaginary line Y is offset from the imaginary line X that passes through the nozzle 240 and the front of the bowl 24 directly opposite the nozzle 240. In the particular embodiment illustrated, the imaginary line Y defines a tangent to the bowl 224 that is located approximately 120 degrees clockwise from the nozzle 240. The geometry of the bowl 224 causes the water flows D and E to gradually cascade downward from opposing directions as they progress toward the imaginary line Y. In this manner, water from flow D and flow E is under enough pressure even under lower pressure conditions to provide complete wetting of the bowl 224.

Figure 18:
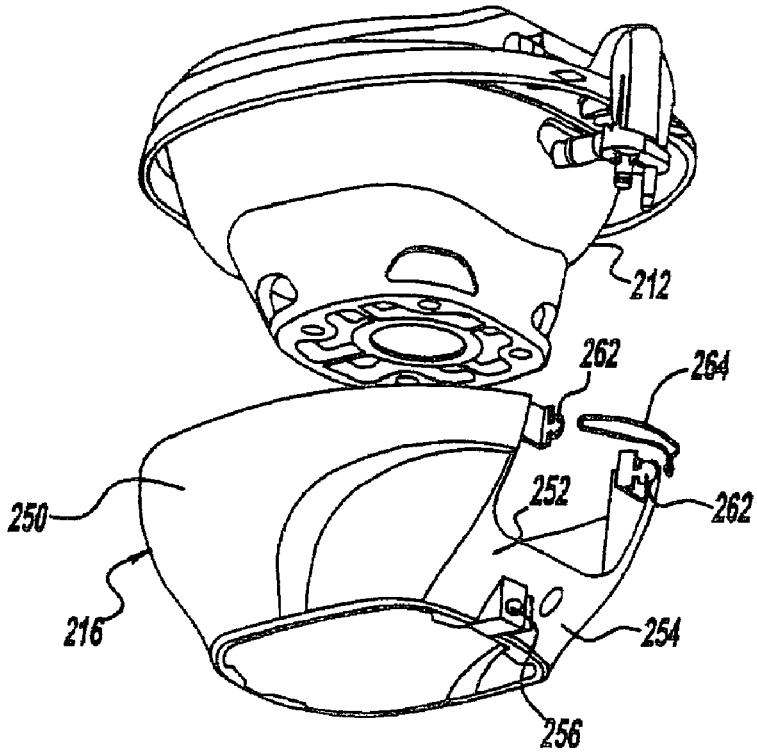
FIG. 18 is a rear perspective view of the flush toilet of FIG. 14 shown partially exploded.

With particular reference to FIGS. 14 through 17, the shroud 216 will be further described. In the embodiment illustrated, the shroud 216 is integrally molded of a plastic material. In one particular application, the shroud 216 is constructed of a polypropylene. As with the shroud 16, the shroud 216 may be constructed of a composite material including a microbacterial agent. The shroud 216 is illustrated to include a side wall 250 that wraps around the base 114 of the toilet 200. As perhaps shown most clearly in the exploded view of FIG. 18, the side wall 250 has two ends 252 and 254 that terminate at a vertically extending centerline. The resilient nature of the shroud 216 allows the ends 252 and 254 to be separated sufficiently from one another for attachment to or removal from the unit 200. An upper edge of the shroud 216 is received between the downwardly extending flange 230 and the sidewall of the bowl assembly 212. A rear side of the shroud 216 is formed to include an opening that accommodate the water valve assembly 40. The plastic material of the shroud 216 reduces the china material required while maintaining an aesthetically pleasing appearance and providing an easier cleaned surface.

Adjacent the lower end of the shroud 216, cooperating structure is provided for securing the first and second ends 252 and 254 together. In this regard, a fastener 256 passes through an aperture (not particularly shown) in a boss portion of the first side and engages a projection 258 of the second side 254. Adjacent an upper edge, the shroud 216 is integrally formed to include a pair of rearwardly extending projections 262. Both of the sides 252 and 254 are formed to include one of the projections 262. The projections 262 receive an elastic member in the form of an O-ring 264 for securing the first and second ends 252 and 254 of the sidewall 250. Removal of fastener 256 and the O-ring 264 allows the shroud 216 to be easily removed from the remainder of the toilet 200 for cleaning or replacement while the bowl assembly 224 is secured to the base 214.

The description of the invention is merely exemplary in nature and, thus, variations that do not depart from the gist of the invention are intended to be within the scope of the invention. Such variations are not to be regarded as a departure from the spirit and scope of the invention. Furthermore, the present invention has been described with reference to two particular embodiments having many common and some distinct features. One skilled in the art will recognize that these features may be used singularly or in any combination based on the requirements and specifications of a given application or design.

What is claimed is:

1. A flush toilet comprising:

a bowl assembly defining a bowl having a discharge outlet at a lower end and a ledge circumferentially extending about a substantial portion of the bowl, the bowl having a rear surface that transitions to the ledge as the bowl continues clockwise and counter clockwise from the rear surface, a horizontal dimension of the ledge increasing as the ledge continues from the rear surface to a front of the bowl, an angle of the ledge increasing as the ledge continues from the rear surface to the front, a maximum slope of the ledge located proximate the front; and a nozzle mounted to the bowl assembly for pressurizing a source of flush water and delivering the source of flush water to the bowl for rinsing and flushing of the bowl, the nozzle positioned at a rear portion of the bowl and operative to produce a first flow of water in a first circumferential direction about the bowl and a second flow of water in a second circumferential direction about the bowl, the second circumferential direction being opposite to the first circumferential direction, the nozzle having a laterally extending channel in communication with a water input, the water input located at a center of the channel, the channel slightly angled downward in both lateral directions from the center.

2. The flush toilet of claim 1, wherein the first and second flows of water converge at an imaginary line passing through the nozzle and a front portion of the bowl directly opposite the nozzle.

3. The flush toilet of claim 1, wherein the first and second flows of water are capable of creating an asymmetrical flow pattern in which the first flow of water circumferentially travels significantly further around the bowl compared to the second flow of water when the first and second flows of water converge.

4. The flush toilet of claim 2, wherein the imaginary line defines a tangent to the bowl located approximately 120 degrees clockwise from the nozzle.

5. The flush toilet of claim 1, wherein the rear surface is generally flat and vertical.

6. The flush toilet of claim 1, wherein the ledge is adapted to cascade the first and second flows of flush water down the bowl as the first and second flows of water move in the first and second circumferential directions, respectively.

7. The flush toilet of claim 5, wherein the nozzle further defines a third flow of water.

8. The flush toilet of claim 1, wherein the channel includes a first end and a second end, the first and second ends being in fluid communication with each other.

9. The flush toilet of claim 1, wherein the first flow is substantially equal to the second flow.

10. The flush toilet of claim 7, wherein the third flow is less than the first flow and the third flow is less than the second flow.

11. The flush toilet of claim 1, wherein the first flow is substantially greater than the second flow.

12. The flush toilet of claim 1, wherein the first and second flows of water create an asymmetrical flow pattern in which the first flow of water circumferentially travels significantly further around the bowl compared to the second flow of water when the first and second flows of water converge.

* * * * *